US007207768B2

(12) United States Patent
Gordon et al.

(10) Patent No.: US 7,207,768 B2
(45) Date of Patent: Apr. 24, 2007

(54) WARNING SYSTEM FOR TURBINE COMPONENT CONTACT

(75) Inventors: Thomas J. Gordon, Winter Springs, FL (US); William Ryan, Oviedo, FL (US); Lawrence Lee Ross, Freeport, PA (US); Brian D. Ottinger, Pittsburgh, PA (US); Richard D. Holm, Pittsburgh, PA (US); Nicholas D'Amico, Irwin, PA (US); Phillip W. Gravett, Orlando, FL (US); Nancy Ulerich, Longwood, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 174 days.

(21) Appl. No.: 11/035,712

(22) Filed: Jan. 15, 2005

(65) Prior Publication Data

US 2006/0159547 A1 Jul. 20, 2006

(51) Int. Cl.
*F01B 25/26* (2006.01)

(52) U.S. Cl. ..... 415/118; 416/61

(58) Field of Classification Search ..... 415/118, 415/119, 191, 211.2; 416/61
See application file for complete search history.

(56) References Cited

U.S. PATENT DOCUMENTS 1,326,651 A * 12/1919 Doran ..... 415/9
1,326,867 A * 12/1919 Junggren ..... 415/9
2,209,466 A 7/1940 Miller
2,684,568 A 7/1954 Senger
2,839,071 A 6/1958 Rosch
3,220,244 A 11/1965 Donnelly
3,573,520 A 4/1971 Dorshimer
3,682,554 A 8/1972 Flaczynski
3,736,751 A 6/1973 Fuller
3,754,433 A 8/1973 Hyer
3,861,818 A 1/1975 Eggenberger
4,831,365 A 5/1989 Thomas et al.
4,971,517 A 11/1990 Perkey et al.
5,150,618 A 9/1992 Bambara
5,225,690 A 7/1993 Sakai et al.
5,479,818 A 1/1996 Walter et al.
6,375,411 B1 4/2002 Ham et al.
6,657,217 B2 12/2003 Adams et al.
6,658,850 B1 * 12/2003 House et al. ..... 60/646
2005/0213548 A1 * 9/2005 Benson et al. ..... 370/338

* cited by examiner

*Primary Examiner*—Edward K. Look
*Assistant Examiner*—Nathan Wiehe

(57) ABSTRACT

Aspects of the invention related to a system for providing advance notice of impending contact between a stationary component and a rotating component in a turbine engine. For example, the system can be used to warn of potential contact between a seal holder and a rotor disk in the compressor section of the engine. In one embodiment, a pad or other component can be provided on the stationary seal holder. If the seal holder and the rotor disk approach each other during operation, the pad can contact the rotor disk prior to actual contact between the seal holder and the rotor disk. An optical and/or an acoustic signal can be generated by such contact. The signals can be detected remotely from the point of contact by a signal detection device, thereby avoiding the need to pass wires through the compressor section.

21 Claims, 10 Drawing Sheets

WARNING SYSTEM FOR TURBINE COMPONENT CONTACT

FIELD OF THE INVENTION

The invention relates in general to turbine engines and, more specifically, to a system for providing advance warning of contact between a stationary component and a neighboring rotating component in a turbine engine.

BACKGROUND OF THE INVENTION

In a turbine engine, there are numerous instances in which a stationary component is positioned in close proximity to a rotating component. Severe consequences can arise if these substantially adjacent components come into contact with each other. One area of concern is in the compressor section of a gas turbine engine.

An example of a compressor section is shown in FIG. 1. The compressor section 10 can be housed within a casing or shell 12. The outer casing 12 can be made of two generally semi-cylindrical halves that can be secured together. The outer casing 12 encloses, among other things, a rotor (not shown) having a plurality of disks 14 that extend radially outward therefrom. A plurality of airfoils or blades 16 can be mounted on each disk 14 to form a row. The rows of blades 16 alternate with rows of stationary airfoils or vanes 18. In some instances, the vanes 18 can be provided in the form of a diaphragm 20. Each diaphragm 20 can include inner and outer radial bands 22,24, known as shrouds, with a plurality of vanes 18 circumferentially arrayed therebetween. Like the compressor shell 12, the diaphragm 20 can be made of two substantially semi-circular halves. The diaphragm 20 can be attached to and extend radially inward from the compressor shell 12. For example, the compressor shell 12 can include a circumferential slot 26 along its inner peripheral surface 25 for receiving the outer shroud 24 so as to attach the diaphragm 20 to the shell 12.

As is known in the art, a seal holder 28 can be attached to the inner shroud 22 of the diaphragm 20. One or more seals 30 can extend from the seal holder 28. One or more surfaces of the seal holder 28 can be in close proximity to one or more surfaces of the rotor disk 14. During engine operation, the seal holder 28 and the rotor disk 14 should be spaced from each other; however, contact 32 between the seal holder 28 and the neighboring rotor disk 14 has been known to occur, as shown in FIG. 2. Serious damage can result if portions of the seal holder 28 liberate and travel through the compressor 10.

Prior attempts at detecting such contact in advance have included the use of proximity sensors to measure the distance between the seal holder 28 and the rotor disk 14. While providing continuous measurement of the distances between the seal holder 28 and the rotor disk 14, such sensors are impractical for general application because they require wiring to be run from outside of the casing 12 down to the seal holder 28. This wiring must be routed down the axial downstream side of the compressor diaphragm vanes 18.

The durability of the wiring is doubtful in such an environment. In addition, the presence of the wiring can degrade the performance of the compressor. Further, multiple sensors may be required for each compressor row; in the event of a sensor failure, replacement of a failed sensor would be time-consuming and costly. Thus, not only is there a need for a system that can provide advance warning of contact between a stationary component and a nearby rotating component, but there is also a need for a system that can detect such contact remotely so as to avoid the need to have wires extending inside of the compressor.

SUMMARY OF THE INVENTION

Aspects of the invention relate to a system for providing advance warning of contact of neighboring turbine engine components. One component is a stationary turbine engine component, which can be, for example, a compressor disk. The other component is a rotating turbine engine component, such as a seal holder. The rotating turbine engine component is substantially proximate to the stationary turbine engine component so as to define a gap therebetween.

A contact sensor extends from one of the stationary component and the rotating component into the gap toward the opposing component. The contact sensor is responsive to contact with the opposing component by generating a warning signal. Thus, the signal provides advance warning of impending contact between the stationary and rotating turbine engine components.

In one embodiment, the contact sensor can be provided on the stationary turbine engine component. The contact sensor can be a pad secured to one of the stationary component and the rotating component. The pad can have at least two layers. An outer layer can produce a first acoustic warning signal upon contact with the opposing turbine engine component, and an inner layer can produce a second acoustic warning signal upon contact with the opposing turbine engine component. The first acoustic warning signal can be acoustically distinct from the second acoustic warning signal.

The warning signal can be an acoustic signal. In such case, the system can also include at least one acoustic detection device for remotely sensing the acoustic signal. Thus, the need to pass wires along the first or second turbine engine components so as to provide the acoustic detection device near the point of contact is avoided.

Alternatively, the warning signal can be an optical signal. In such case, the system can include an optical detection device for remotely sensing the optical signal. As a result, the need to pass wires along the first or second turbine engine components so as to provide the optical detection device near the point of contact is avoided.

Embodiments of the invention are further directed to an acoustic based system for warning of impending contact between turbine engine components. The system can include a rotor disk and a seal holder extending from at least one stationary airfoil. The seal holder is substantially proximate to the rotor disk. A strike strip extends from the seal holder and toward the rotor disk. In one embodiment, a strike pad can provided on the rotor disk for contacting the strike strip. The strike strip can be substantially aligned with the strike pad. Due to such an arrangement, at least one acoustic warning signal is generated in response to contact between the strike strip and the rotor disk, thereby providing advance warning of impending contact between the rotor disk and the seal holder.

The system can further include an acoustic detection device for remotely sensing the at least one acoustic signal generated as a result of the contact between the strike strip and the rotor disk. As a result, the use of wires extending along the rotor disk or the seal holder can be avoided. The acoustic detection device can be operatively associated with at least one of a signal processor and a signal recorder.

The rotor disk and the seal holder can be enclosed within a compressor shell. The compressor shell can have an outer peripheral surface and an inner peripheral surface. The acoustic detection device can be provided on the outer peripheral surface of the compressor shell so as to avoid the routing of wiring inside of the compressor shell. Alternatively, an opening can extend through the compressor shell between the inner and outer peripheral surfaces. Thus, the acoustic detection device can be provided within the opening so as not to protrude substantially beyond the inner peripheral surface of the shell. Such an arrangement can also avoid the routing of wiring inside of the shell.

The system can further include a vibration detection device operatively associated with the at least one stationary airfoil so as to sense vibration of the at least one stationary airfoil induced by the contact between the strike strip and rotor disk.

Aspects of the invention also relate to an optical based system for warning of impending contact between turbine engine components. The system includes a rotor disk and a seal holder extending from a stationary vane. The seal holder can be substantially proximate to the rotor disk so as to define a gap therebetween. A strike rod extends from the seal holder extending from the seal holder into the gap. In one embodiment, at least a portion of the strike rod can be made of ferrocerium.

An optical signal is generated in response to contact between the strike rod and the rotor disk. In one embodiment, the optical signal can be a spark. The system can further include a strike plate provided on the rotor disk for contacting the strike rod to produce an optical signal. Alternatively, the rotor disk can include at least one raised area for contacting the strike rod. Thus, the optical signal provides advance warning of impending contact between the rotor disk and the seal holder.

The system can include an optical detection device for remotely sensing the at least one optical signal generated as a result of the contact between the strike strip and the rotor disk. The expected interface between the strike strip and the rotor disk can be within the view of the optical detection device. Thus, the use of wires extending along the rotor disk and the seal holder are avoided. The optical sensing device can be operatively associated with at least one of a signal processor and a signal recorder.

The rotor disk and the seal holder can be enclosed within a shell. The shell can have an inner peripheral surface and an outer peripheral surface. An opening can extend through the shell between the inner and outer peripheral surfaces. The optical detection device can be provided within the opening so as not to protrude substantially beyond the inner peripheral surface of the shell. Thus, the routing of wiring inside of the shell is avoided.

DETAILED DESCRIPTION OF EMBODIMENTS OF THE INVENTION

Figure 1:
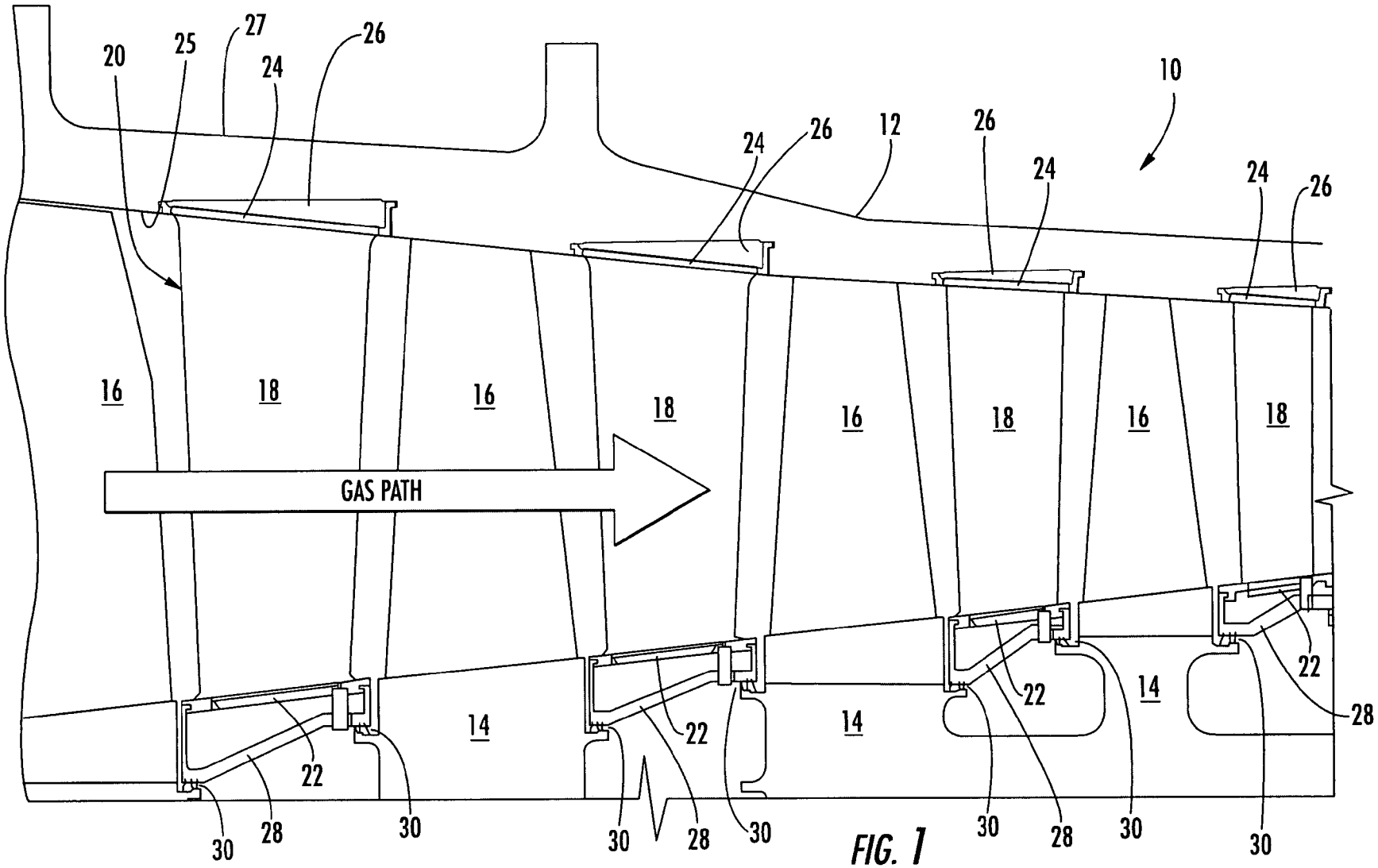
FIG. 1 (PRIOR ART)
FIG. 1 is a cross-sectional view through a portion of a prior compressor section of a turbine engine.
Figure 2:
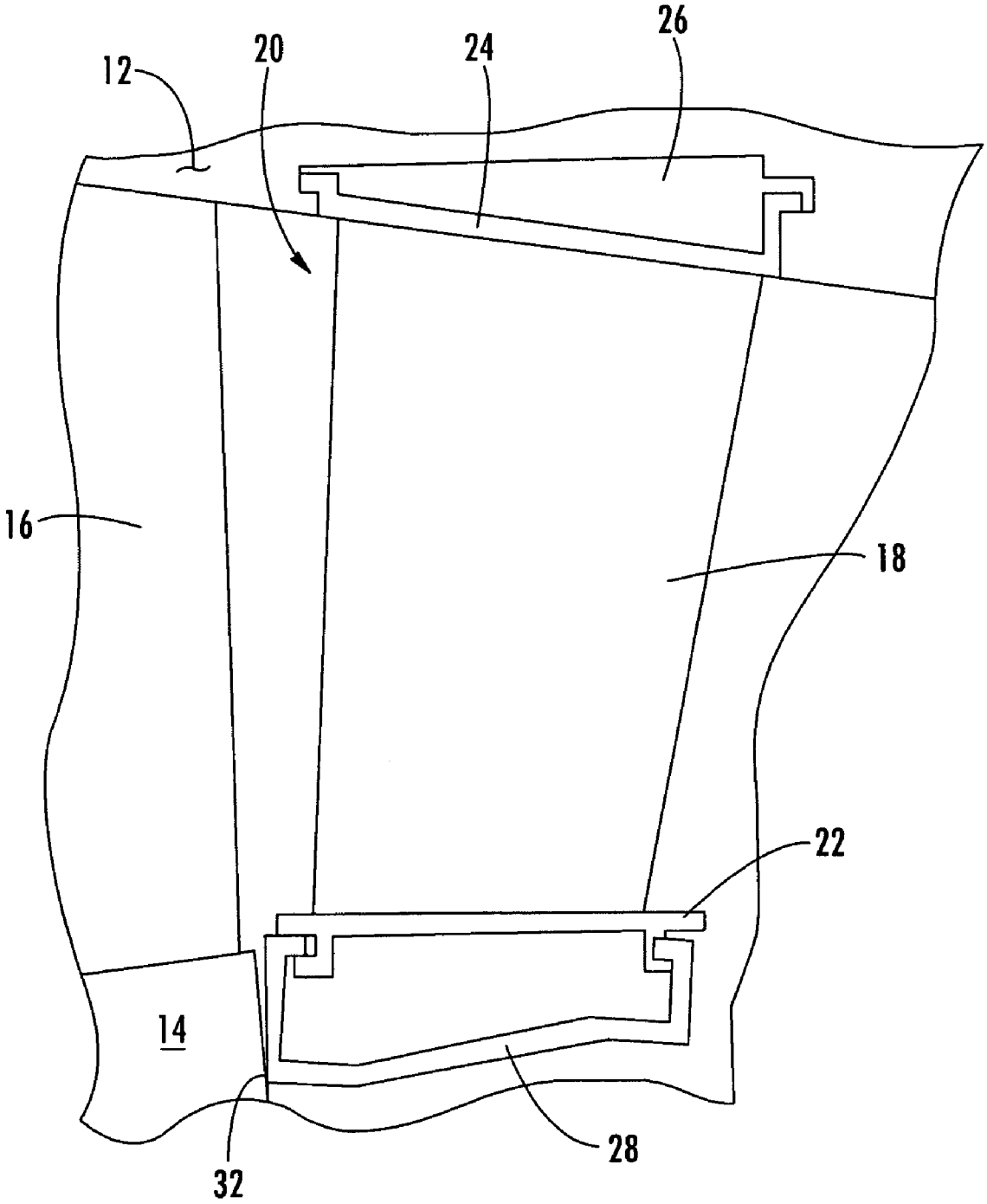
FIG. 2 (PRIOR ART)
FIG. 2 is a cross-sectional close-up view of an adjacent rotating blade and stationary vane pair, showing the seal holder contacting the rotor disk.

Embodiments of the present invention address the need for a system that can provide early warning of potential contact between a stationary component and a rotating component in a turbine engine. Embodiments of the invention will be explained in the context of one particular area of the engine, but the detailed description is intended only as exemplary. Embodiments of the invention are shown in FIGS. 3–10, but the present invention is not limited to the illustrated structure or application.

A system according to embodiments of the invention can alert an operator when the spacing between a pair of neighboring stationary and rotating turbine engine components in a turbine engine decreases to a predetermined distance. The rotating and stationary components can be substantially proximate to each other so as to define a gap therebetween. A contact sensor can be provided on one of the stationary component and the rotating component. The contact sensor can extend into the gap toward the opposing component. The contact sensor can be responsive to contact with the opposing component by generating a warning signal, which can be an acoustic or an optical signal. The warning signal can provide advance warning of impending contact between the stationary and rotating turbine engine components when the gap between these components decreases to a predetermined distance. The contact sensor can be any structure added to one of the components so as to make first contact with the opposing component before any other portions of the rotating and stationary components come into contact and generate a warning signal.

Aspects of the invention can be applied in connection with almost any pair of neighboring stationary and rotating components in a turbine engine. For example, the stationary component can be the seal holder 28 attached to the inner shroud 22 of the compressor diaphragm 20, and the rotating component can be the rotor risk 14. Thus, a system according to embodiments of the invention can provide warning when the spacing between the seal holder 28 and the disk 14 decreases to a predetermined distance.

Figure 3:
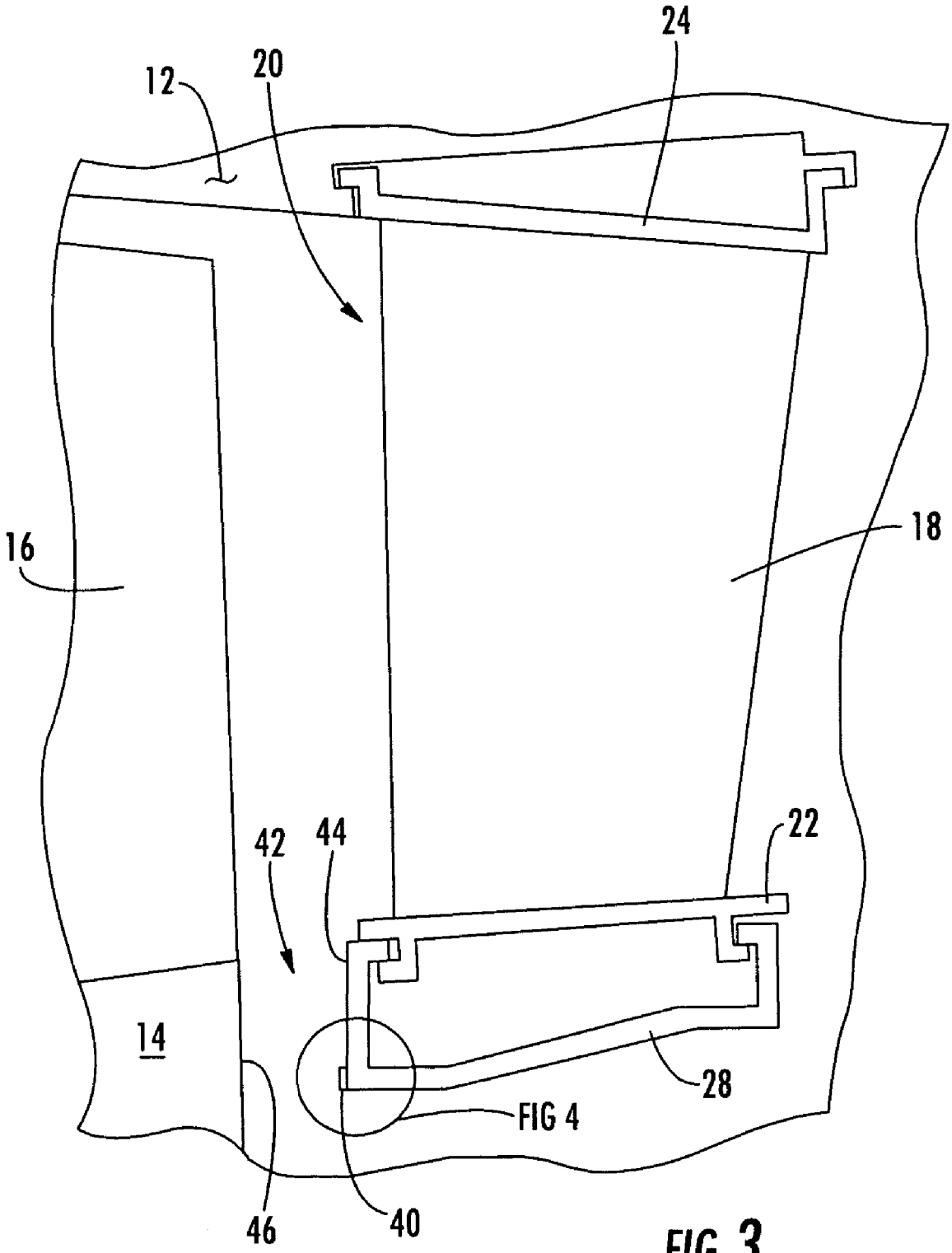
FIG. 3 shows an acoustic-based warning system according to embodiments of the invention.

For example, the system can be configured to acoustically warn of impending contact. One acoustic-based system according to embodiments of the invention is shown in FIG. 3. In one embodiment, the contact sensor can be a pad 40 provided on one of the seal holder 28 and the rotor disk 14. The pad 40 can be provided on one or more surfaces of the seal holder 28 or the rotor disk 14. For example, in one compressor design, a gap 42 can be defined between the axial upstream face 44 of the seal holder 28 and the axial downstream face 46 of the rotor disk 14. As used herein, the term axial herein refers to the operational position of a component relative to the general direction of air flow through the compressor. A pad 40 according to embodiments can be attached to one of the faces 44, 46 and extend into the gap 42 and toward the opposing face. Preferably, the pad 40 is attached to the axial upstream face 44 of the seal holder 28. The distance that the pad 40 projects into the gap 42 can be determined at least with respect to the spacing between the rotor disk 14 and the seal holder 28 at which a user wants to receive warning.

Contact between the pad 40 and the rotor disk 14 can produce an acoustic signal. Accordingly, the pad 40 can be made of any of a number of materials including, for example, spring steels or materials having bronze. Preferably, the pad 40 is made of a material that is softer than the material of the rotor disk 14 to prevent damage to the rotor 14 in the event of contact. Ideally, the pad 40 is made of a material that can produce a distinctive acoustic signal or signature when it comes into contact with the rotor disk 14.

Figure 4A:
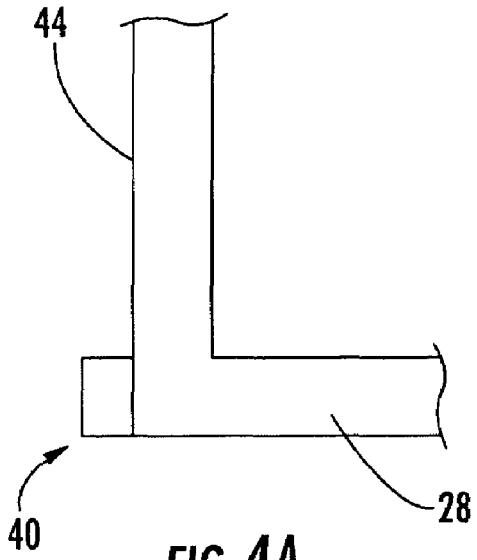
FIG. 4A is a close-up view of a first warning pad according to embodiments of the invention.
Figure 4B:
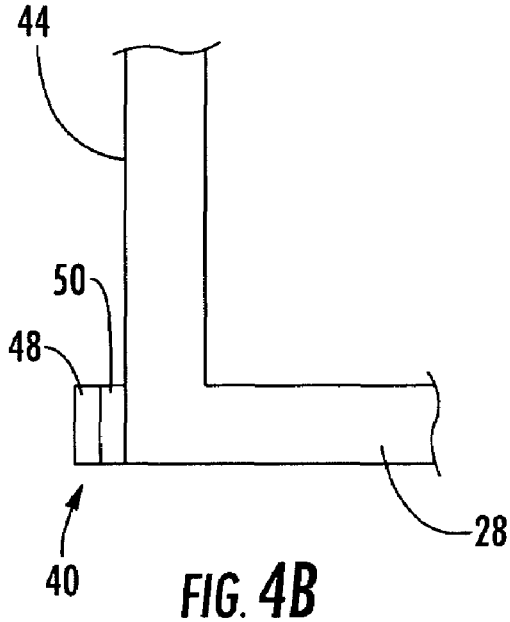
FIG. 4B is a close-up view of a second warning pad according to embodiments of the invention.

The pad 40 can be made out of a single material, as shown in FIG. 4A. But, in one embodiment, the pad 40 can have two or more layers of different material, as shown in FIG. 4B. Such a multi-layered pad 40 can be used to monitor progression of the seal holder 28 and the rotor disk 14 toward each other. For instance, a two layer pad 40 can have an outer layer 48 and an inner layer 50. When the pad contacts the rotor disk 14, the outer layer 48 can. produce a first acoustic signal. If the seal holder 28 and the rotor disk 14 continue to move closer to each other, the pad 40 will wear and eventually the inner layer 50 will be exposed. When the inner layer 50 of the pad 40 contacts the rotor disk 48, a second acoustic signal can be produced. The second acoustic signal is preferably acoustically distinct from the first acoustic signal. To that end, the material for each layer can be selected so that the frequency of the acoustic signal associated with each layer can vary to indicate different levels of criticality. For example, each of the layers 48, 50 can be made of a soft steel to avoid damaging the rotor disk 14. In addition to different materials, the thickness of the layers 48, 50 can be varied to obtain different frequency modes. The multiple layers of the pad 40 can be joined together in any of a number of ways including brazing, welding and adhesives, just to name a few possibilities.

The pad 40 can be secured at one end to the seal holder 28 by, for example, welding, brazing, adhesives, or fasteners. It will be understood that the pad 40 can have any of a number of shapes and sizes. For instance, the pad 40 can be substantially circular, rectangular or triangular in cross-section. Further, the pad 40 can be an elongated strip that extends about the entire axial forward face 44 of the seal holder 28. While embodiments of the invention have been discussed in connection with a single pad, the invention is not limited to having a single pad. In one embodiment, there can be more than one pad. In the case of two or more pads, the pads can be arranged in various ways. The two or more pads can but need not be identical to each other in any of the respects discussed above.

Figure 5:
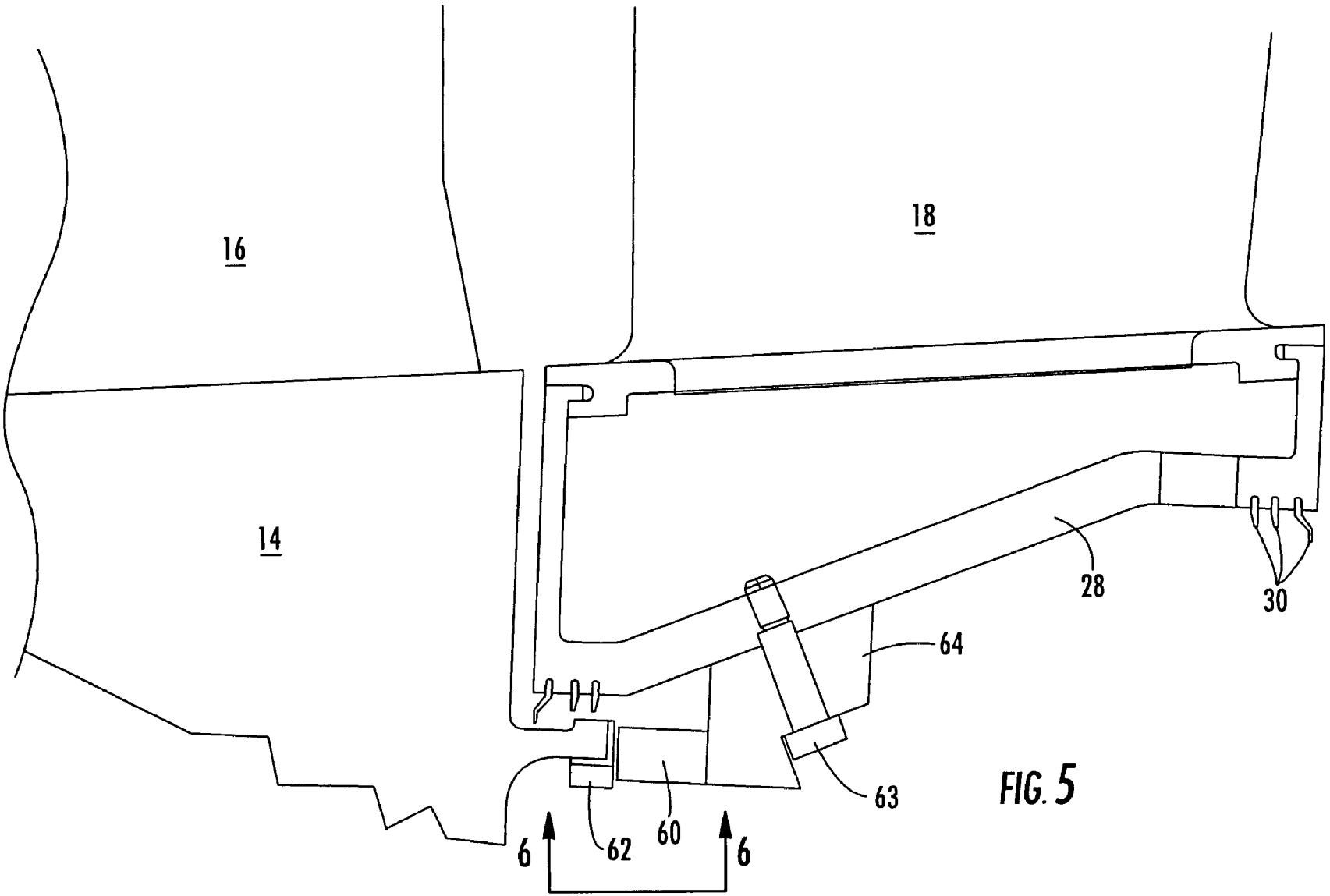
FIG. 5 shows another acoustic-based warning system according to embodiments of the invention.
Figure 6:
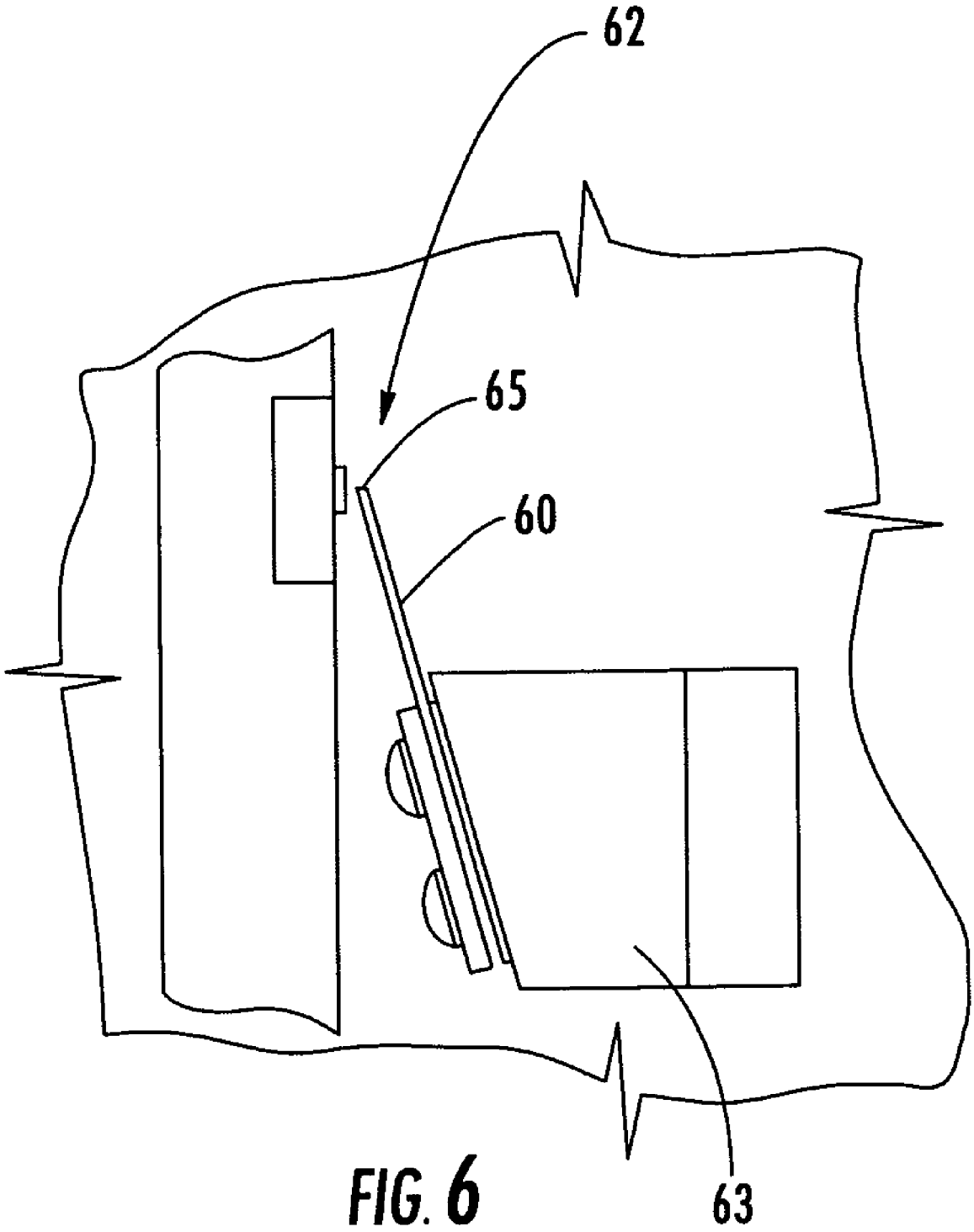
FIG. 6 shows a view of an acoustic-based warning system according to embodiments of the invention, taken along line 6—6 in FIG. 5.
Figure 7:
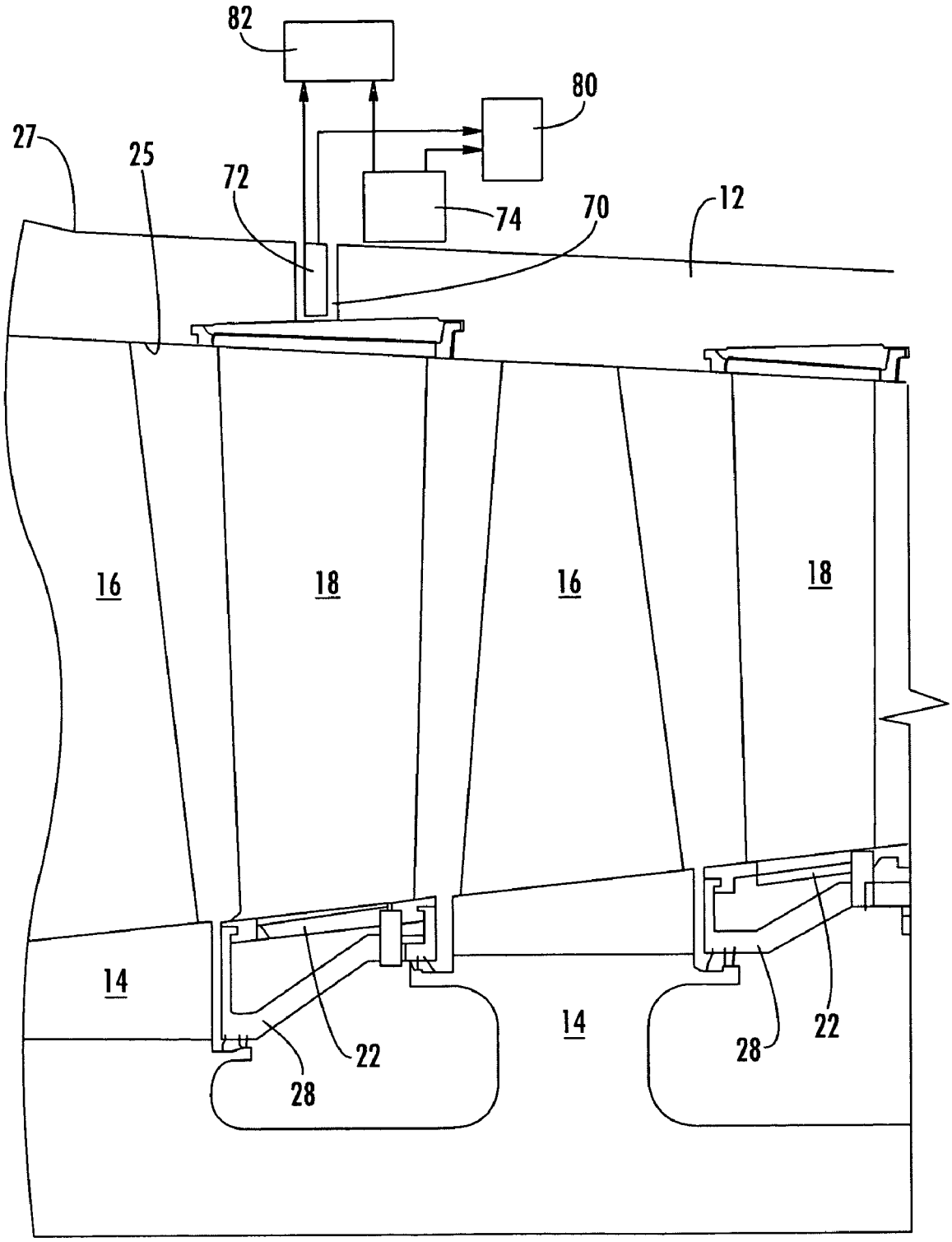
FIG. 7 is a partial diagrammatic view of an acoustic-based warning system according to embodiments of the invention, showing devices for acoustic detection, processing and recording.

Another possible acoustic-based system is shown in FIGS. 5–6. In such case, the contact sensor can be one or more strike strips 60 can be provided on the seal holder 28 for contacting the rotor disk 14 prior to actual contact occurring between the seal holder 28 and the rotor disk 14. Embodiments of the invention can further include the opposite arrangement in which the strike strips 60 are provided on the rotor disk 14 for contacting the seal holder 28 prior to actual contact occurring between the seal holder 28 and the rotor disk 14.

The strike strip 60 can be made of spring steel to elastically deflect at each contact with the strike pad 62 without breaking or wearing rapidly. The strike strip 60 can be connected to the seal holder 28 by, for example, bolts 63 and/or tack welding. The strike strip 60 can extend like a cantilevered spring from the seal holder 28. In one embodiment, the strike strip 60 can be attached directly to the seal holder 28; in another embodiment, the strike strip 60 can be indirectly attached to the seal holder 28, such as by a mounting block 64. The strike strip 60 can be attached to the seal holder 28 at or near the anticipated region of first contact with the rotor disk 14. For example, the strike strip 60 can be provided on the upper diaphragm half at about the 9:30 position when looking in the direction of the flow through the compressor. The location of the strike strip 60 can vary in each row of the compressor 10.

As noted above, the strike strip 60 can directly contact the rotor disk. Alternatively, one or more strike pads 62 can be provided on the rotor disk 14. The strike pad 62 can be made of carbon steel. The strike pad 62 can be attached to the rotor disk 14 in numerous ways including brazing, welding, fasteners or adhesives, just to name a few possibilities. The strike pad 62 can be any of a number of shapes and have any of a number of cross-sectional profiles.

In any case, the tip 65 of the strike strip 60 can be spaced from the strike pad 62. For all known engine operating conditions the system is preferably arranged so that the only contact possible between the rotor disk and the seal holder is between the strike strip 60 and the strike pad 62. The strike strip 60 and the strike pad 62 can be configured such that warning is provided well before actual contact between the rotor disk 14 and the seal holder 28 occurs. Ideally, the strike strip 60 and the strike pad 62 can be configured to allow continued operation of the engine so that an outage can be scheduled.

When the strike strip 60 and the strike pad 62 contact each other, an acoustic signal can be generated with characteristic frequencies. Contact can also shock excite the natural frequency of the strike strip 60 and possibly the diaphragm 20 as well. Detectablity of these frequencies can depend on amplitude peaks of the acoustic signal exceeding background acoustic levels at these same frequencies. In many instances, background acoustic levels can be expected to be minimal and relatively stable. Ideally, the natural frequency of the strike strip 60 does not coincide with the natural frequency of the diaphragm 20 nor share any other common excitation frequency. Preferably, the natural frequency of the strike strip 60 is higher than most of the natural frequencies of the diaphragm 20 because higher frequency signals can transmit through the structure of the diaphragm 20 more easily. Also, higher modes will tend to have less strain and are less likely to cause a failure if a higher mode is excited.

Regardless of the specific acoustic-based system used, the acoustic response must be detected. To that end, an acoustic detection device can be used to measure and/or sensing a change in acoustic condition or identify an expected. acoustic condition. The acoustic detection device can be located remotely from the seal holder 28 and the rotor disk 14 such that wiring does not have to be connected to an acoustic detection device at or near the seal holder or rotor disk. For example, the acoustic detection device can be provided on the outer peripheral surface 27 of the compressor shell 12. The acoustic detection device can be provided within an opening 70 in the compressor shell 12 so as not to protrude substantially beyond the inner peripheral surface 25 of the compressor shell 12. By providing the acoustic detection devices in such locations, prior problems associated with running wiring inside of the compressor are avoided. Further, the time and labor investment in repairing and replacing the acoustic detection device can be minimized.

In one embodiment, the acoustic detection device can be a dynamic pressure sensor or pressure transducer, such as a microphone 72. The microphone 72 can be attached to the outer peripheral surface 27 of the casing 12 to monitor any change in the acoustic signature of the compressor 10. Alternatively, the pressure transducer 72 can be provided in an opening 70 in the compressor casing 12. The opening 70 can be, for example, a preexisting port for a borescope, or it can be included specifically for receiving the acoustic detection device. A compression fitting can be provided in the opening 70 to provide a pressure seal for penetration of the acoustic detection device through the opening 70. The locations of the opening 70 can vary for each row in the compressor 10.

Separately or in addition, accelerometers 74 can mounted on the compressor shell 12 to detect structure borne vibration in the diaphragm 20 that results from the strike strip 60 contacting the rotor disk 14 or strike pad 62. The accelerometers 74 can be used to provide independent confirmation that strike strip 60 contact has occurred. It should be noted that dynamic pressure sensors and accelerometers are provided in the way of examples, and embodiments of the invention include other acoustic detection devices.

The acoustic detection device can be operatively associated with at least one of a signal processor 80 and a signal recorder 82. Further, the signal processor 80 and the signal recorder 82 can be operatively associated with each other. The signal recorder 82 can record and/or store signals from the compressor 10 for later analysis. The signal recorder 82 can be a tape recorder, such as a multi-channel tape recorder. The tape recorder can be used for off-line analysis of the output signals. A signal processor 80 can be used to analyze the signals in the time domain or in the frequency domain. For instance, an acoustic signal generated by, for example, the contact between the strike strip 60 and the strike pad 62 may be more detectable in the time domain. In such case, the signal processor 80 can be an oscilloscope, which can be used to perform time domain signal analysis. In contrast, the shock excited modes may be better detected in the frequency domain. A signal processor 82 can use Fast Fourier Transform (FFT) to transform data collected by the acoustic detection device to the frequency domain. FFT can be used to identify the characteristic frequency content of the output signal. The acoustic signals and/or the analysis of the signals can be displayed on a monitor (not shown). In addition to subsequent analysis, embodiments of the invention can include real time processing, display and analysis of the acoustic signals.

Figure 8:
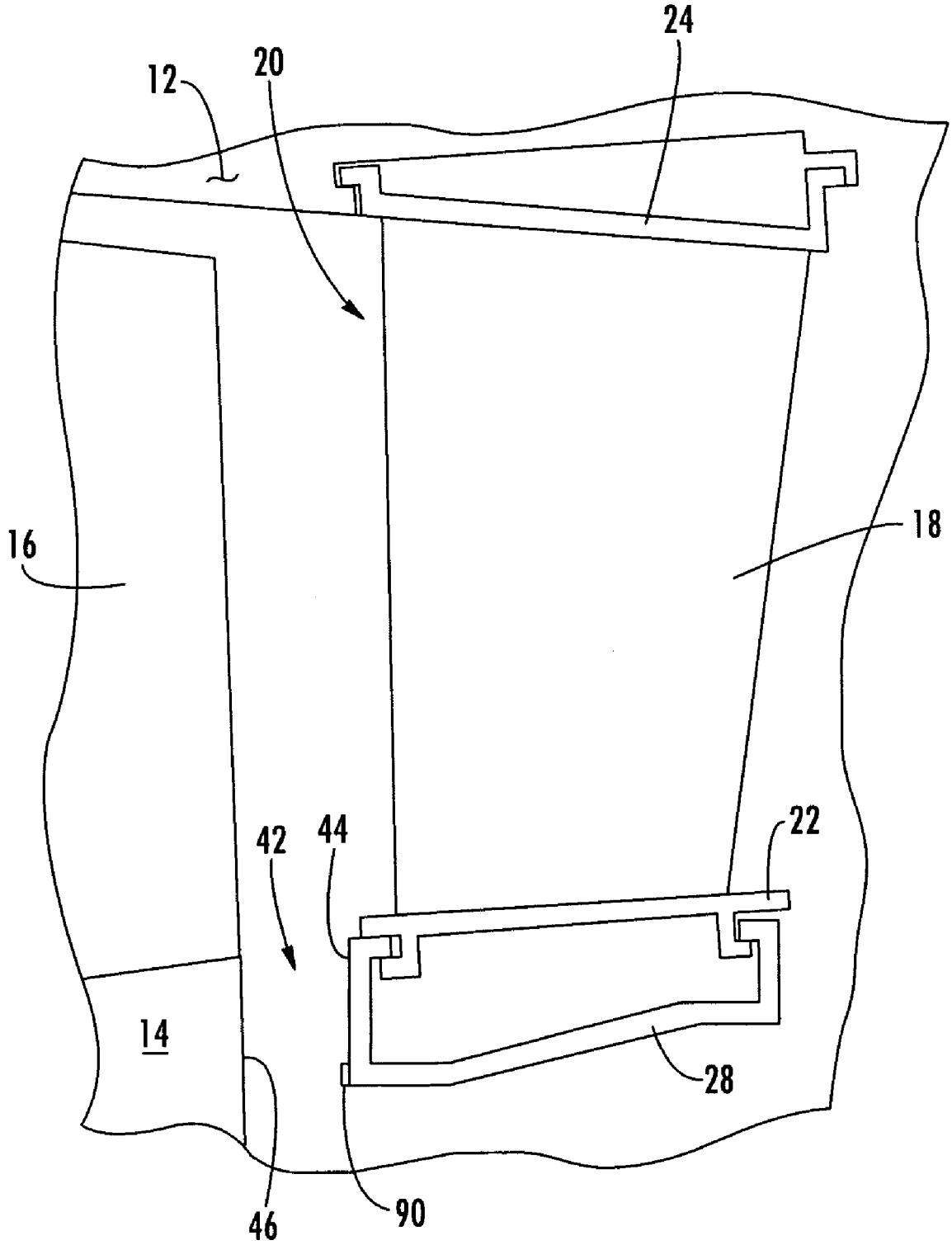
FIG. 8 shows an optical-based warning system according to embodiments of the invention.

Embodiments of the invention can include optical detection systems separate from or in parallel with any of the above-described acoustic detection systems. One optical-based system according to embodiments of the invention is shown in FIG. 8. In such case, the contact sensor can be a pad 90 can be provided on one or more surfaces of the seal holder 28 or the rotor disk 14. For example, in one compressor design, a gap 42 can be defined between the axial upstream face 44 of the seal holder 28 and the axial downstream face 46 of the rotor disk 14. A pad 90 according to embodiments can be attached to one of the faces 44, 46 and extend into the gap 42 and toward the opposing face. Preferably, the pad 90 is attached to the axial upstream face 44 of the seal holder 28. The desired amount of prior warning of contact can be a factor in determining the distance that the pad 90 extends into the gap 42.

The pad 90 can provide an optical response or signal as a warning when it contacts the rotor disk 14. In one embodiment, the optical signal can be a spark. To produce a spark, the pad 90 can be made of any of a number of materials including, for example, ferrocerium. Ferrocerium can be a mixture of cerium and iron. In one embodiment, the mixture can be about 70% cerium and about 30% iron. The pad 90 can be made of any of a number of materials so long as it produces an optical signal when the pad 90 contacts the rotor disk 14. Preferably, the pad 90 is made of a material that is softer than the material of the rotor disk 14 to prevent damage to the disk 14 in the event of contact.

In another embodiment, a strike rod 94 can be mounted on the seal holder 28 such that the tip 95 of the rod 94 extends into the axial gap 42. At least the tip 95 of the rod 94 can be made of ferrocerium. The strike rod 94 can be a single piece or it can be made of multiple pieces. Further, the strike rod 94 can include other hardware such as a housing 96.

Figure 9:
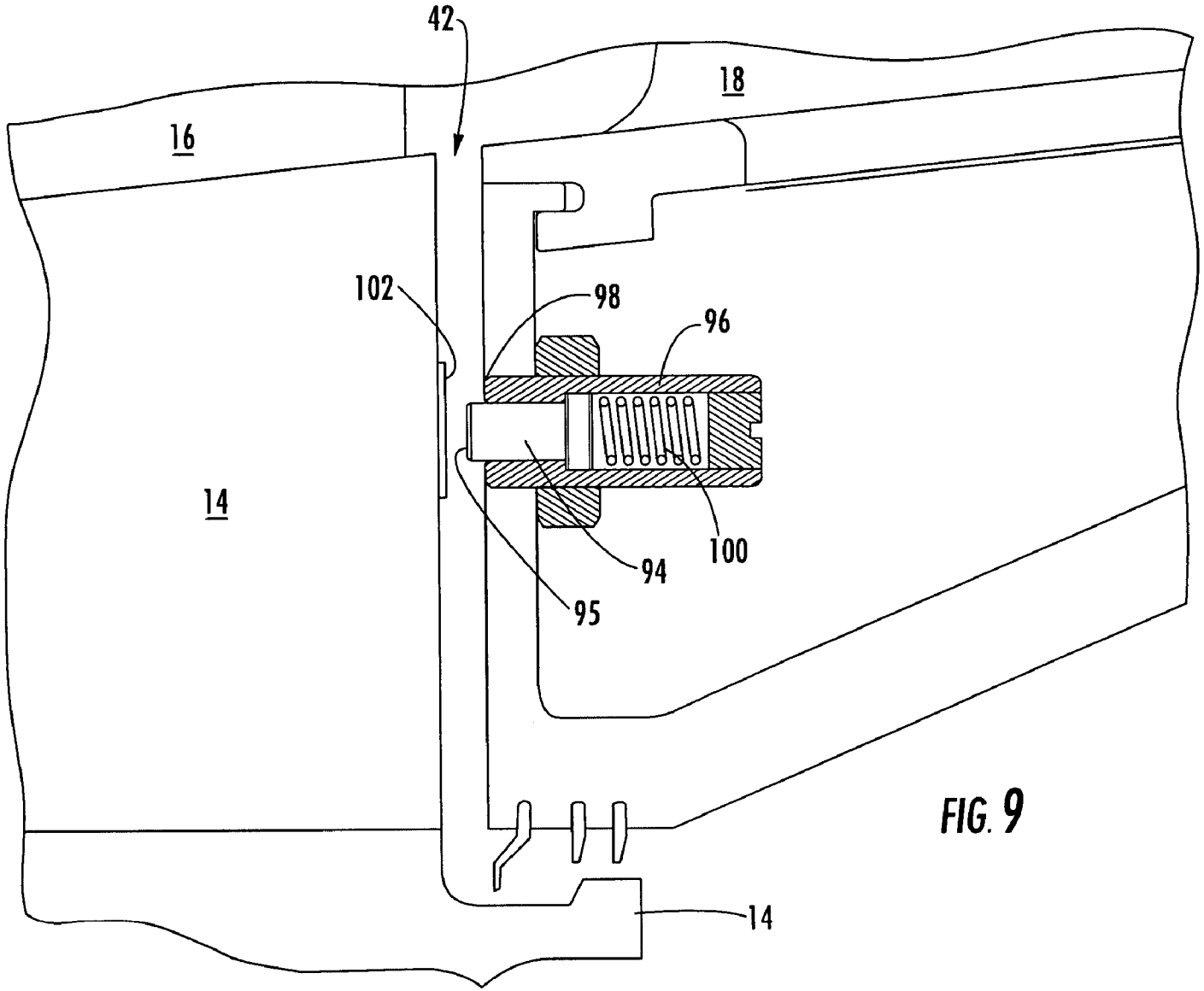
FIG. 9 shows another embodiment of an optical-based warning system according to embodiments of the invention.

The strike rod 94 can be secured to the seal holder 28 in any of a number of ways. For example, as shown in FIG. 9, an opening 98 can be provided in the seal holder 28 for receiving the strike rod 94. The strike rod 94 can be held in place by, for example, fasteners, adhesives, brazing, welding, fasteners or mechanical engagement. Preferably, the strike rod 94 is adjustable so that the tip 95 can be positioned as needed within the gap 42. In one embodiment, the strike rod 94 can be biased with a spring 100. The spring-loaded configuration may be advantageous in instances of contact under high forces. During such occurrences, the strike rod 94 can be temporarily forced into a retracted position to lessen the contact force, thereby minimizing the likelihood that the rod 94 will break. Alternatively, the strike rod 94 can have a threaded portion (not shown) that engages a mating threaded opening (not shown) in the housing 96. Thus, the amount that the strike rod 94 protrudes into the gap 42 can be adjusted using a tool, such as a screwdriver; thus, a desired amount of advance warning can be provided prior to actual contact between the rotor disk 14 and the seal holder 28.

The strike rod 94 can directly contact the rotor disk 14 to produce an optical signal. In one embodiment, the rotor disk 14 can include one or more raised areas positioned to contact the strike rod 94. Such raised areas can be formed, for example, by upsetting the material of the disk 14, such as by punching, so that some of the base material protrudes from the rotor surface toward the seal holder 28. Preferably, the strike rod 94 can contact a strike plate 102 provided on the rotor disk 14. Such a configuration can avoid damage to the rotor disk 14. In addition, any output signals generated by the contact between the strike plate 102 and the strike rod 94 would be rotationally dependent; that is, the time between consecutive signals would be related to the rotational speed of the rotor disk 14, thus, making it easier to identify the optical signals.

It is preferred if the strike plate 102 provides a rough surface. For example, the strike plate 102 can be made of metallic sand paper. The strike plate 102 can be secured to the rotor disk 14 in any of a number of ways including welding, brazing, adhesives, bonding and epoxy, just to name a few possibilities. There can be any number of strike plates 102, and the one or more strike plates 102 can be placed at various positions around the rotor disk 14. In one embodiment, there can be two strike plates 102 provided on the rotor disk 14 at about 180 degrees apart. The strike plate 102 can be any of a number of shapes and sizes, and embodiments of the invention are not limited to any specific shape or size.

Figure 10:
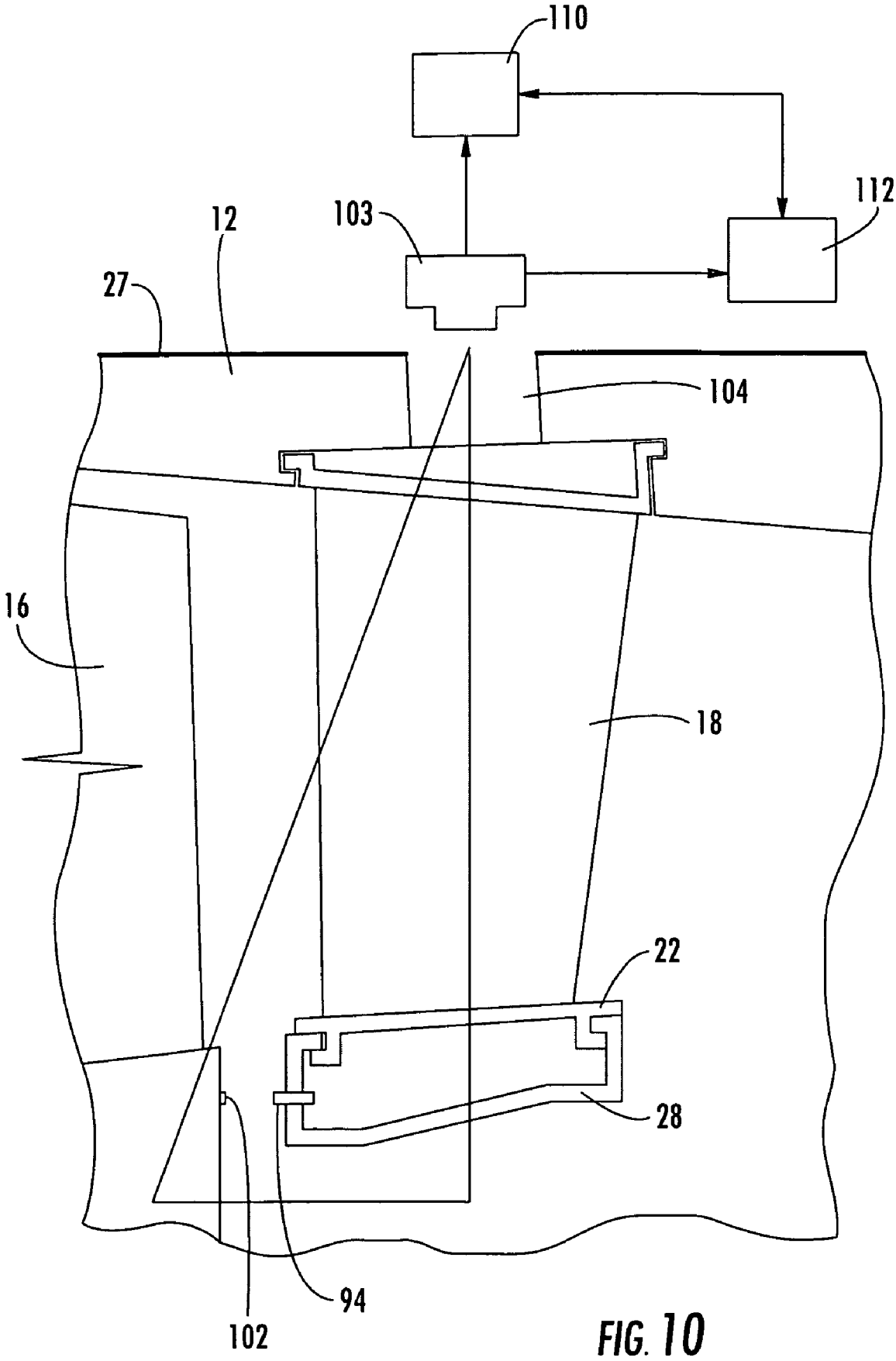
FIG. 10 is a partial diagrammatic view of an optical-based warning system according to embodiments of the invention, showing devices for optical detection, processing and recording.

When the strike rod 94 and the strike plate 102 come into contact, an optical signal is generated. In one embodiment, the optical signal can be a spark. As shown in FIG. 10, an optical detection device 103 can be provided to detect the optical signal. Because it is usually dark inside of the compressor, the light of the sparks can be more easily detected by the optical detection device 103. Preferably, the optical detection device 103 is located remote from the seal holder 28 and the rotor disk 14 so as to avoid the need to have wiring inside of the compressor 10, particularly in the flow path. For example, the optical detection device 103 can be mounted on the outer peripheral surface 27 of the compressor casing 12. An opening 104 can be provided in the compressor shell 12 to permit the optical detection device 103 to view the interface between the rotor disk 14 and the seal holder 22, particularly in the area of expected contact between the strike rod 94 and the strike plate 102. The surfaces of the compressor blades and vanes can be reflective, so it may not necessary for the optical detection device 103 to be able to directly view the interface.

The opening 104 can be a preexisting opening, such as a borescope port, or the opening 104 can be provided for purposes of the optical detection device 103. The optical detection device 103 can extend into the opening 104, but it is preferred if the optical detection device 103 does not extend substantially beyond the inner peripheral surface of the compressor shell 12. The compression fitting can be provided in the opening 104 to provide a pressure seal for penetration of the optical detection device 103 through the opening 104. The locations of the opening 104 can vary for row in the compressor 10.

The optical detection device 103 can be any device for sensing an optical signal. In one embodiment, the optical detection device 103 can be a spark detector. The spark detector can include one or more fiber optics that extend into the opening 104. The spark detector can operate in the wavelength range of 700 nanometers to about 1000 nanometers, which is in the near infrared spectrum.

The optical signal detection device 103 can be operatively associated with a signal processor 110 and/or a signal recorder 112. The signal processor 110 and the signal recorder 112 can be operatively associated with each other. Correctional action can be taken if analysis reveals an optical signal generated as a result of contact between the strike rod 94 and the strike plate 102.

The foregoing description is provided in the context of one pair of stationary and rotating components in a turbine engine. Of course, embodiments of the invention can be employed with respect to other areas of the engine such as the turbine section. Further, there are myriad warning systems within the scope of the invention, including all of those described above, as one skilled in the art would appreciate. Thus, it will of course be understood that the invention is not limited to the specific details described herein, which are given by way of example only, and that various modifications and alterations are possible within the scope of the invention as defined in the following claims.

What is claimed is:

1. A system for providing advance warning of contact of neighboring turbine engine components comprising:

a stationary turbine engine component;

a rotating turbine engine component substantially proximate to the stationary turbine engine component so as to define a gap therebetween; and a contact sensor extending from one of the stationary component and the rotating component into the gap toward the opposing component, wherein contact sensor is responsive to contact with the opposing component by generating a warning signal, wherein the pad comprises at least two layers, wherein an outer layer produces a first acoustic warning signal upon contact with the opposing turbine engine component and an inner layer produces a second acoustic warning signal upon contact with the opposing turbine engine component, wherein the first acoustic warning signal is acoustically distinct from the second acoustic warning signal, wherein the contact sensor is a pad secured to one of the stationary component and the rotating component, whereby the signal provides advance warning of impending contact between the stationary and rotating turbine engine components.

2. The system of claim 1, wherein the contact sensor is provided on the stationary turbine engine component.

3. The system of claim 1, wherein the rotating turbine engine component is a compressor disk and the stationary turbine engine component is a seal holder.

4. The system of claim 1, wherein the warning signal is an acoustic signal.

5. The system of claim 4, further including at least one acoustic detection device for remotely sensing the acoustic signal, whereby the need to pass wires along the first or second turbine engine components so as to provide the acoustic detection device near the point of contact is avoided.

6. The system of claim 1, wherein the warning signal is an optical signal.

7. The system of claim 6, further including an optical detection device for remotely sensing the optical signal, whereby the need to pass wires along the first or second turbine engine components so as to provide the optical detection device near the point of contact is avoided.

8. A wireless acoustic based system for warning of impending contact between turbine engine components comprising:

a rotor disk;

a seal holder extending from at least one stationary airfoil, wherein the seal holder is substantially proximate to the rotor disk, and a strike strip extending from the seal holder and toward the rotor disk;

wherein at least one acoustic warning signal is generated and transmitted wirelessly in response to contact between the strike strip and the rotor disk, whereby the at least one acoustic signal provides advance warning of impending contact between the rotor disk and the seal holder.

9. The system of claim 8 further including an strike pad provided on the rotor disk for contacting the strike strip, wherein the strike strip is substantially aligned with the strike pad.

10. The system of claim 8 further including an acoustic detection device for remotely sensing the at least one acoustic signal generated as a result of the contact between the strike strip and the rotor disk, whereby the use of wires extending along the rotor disk or the seal holder is avoided.

11. The system of claim 10 wherein the acoustic detection device is operatively associated with at least one of a signal processor and a signal recorder.

12. The system of claim 8 wherein the rotor disk and the seal holder are enclosed within a compressor shell, the compressor shell having an outer peripheral surface, wherein an acoustic detection device is provided on the outer peripheral surface of the compressor shell, whereby the routing of wiring inside of the shell is avoided.

13. The system of claim 8 wherein the rotor disk and the seal holder are enclosed within a compressor shell, the compressor shell having an inner peripheral surface, an outer peripheral surface and an opening extending therebetween wherein an acoustic detection device is provided within the opening so as not to protrude substantially beyond the inner peripheral surface of the shell, whereby the routing of wiring inside of the shell is avoided.

14. The system of claim 8 further including a vibration detection device operatively associated with the at least one stationary airfoil so as to sense vibration of the at least one stationary airfoil induced by the contact between the strike strip and rotor disk.

15. An optical based system for warning of impending contact between turbine engine components comprising:

a rotor disk;

a seal holder extending from a stationary vane, wherein the seal holder is substantially proximate to the rotor disk so as to define a gap therebetween; and a strike rod extends from the seal holder into the gap, wherein an optical signal is generated in response to contact between the strike rod and the rotor disk, wherein the optical signal is a spark, whereby the optical signal provides advance warning of impending contact between the rotor disk and the seal holder.

16. The system of claim 15, further including a strike plate provided on the rotor disk for contacting the strike rod to produce an optical signal.

17. The system of claim 15, wherein at least a portion of the strike rod is made of ferrocerium.

18. The system of claim 15, wherein the rotor disk includes at least one raised area for contacting the strike rod.

19. The system of claim 15, further including an optical detection device for remotely sensing the at least one optical signal generated as a result of the contact between the strike strip and the rotor disk, wherein the expected interface between the strike strip and the rotor disk is within the view of the optical detection device, whereby the use of wires extending along the rotor disk and the seal holder are avoided.

20. The system of claim 19 wherein the optical sensing device is operatively associated with at least one of a signal processor and a signal recorder.

21. The system of claim 19 wherein the rotor disk and the seal holder are enclosed within a shell, the shell having an inner peripheral surface and an outer peripheral surface and an opening extending therebetween, wherein the optical detection device is provided within the opening so as not to protrude substantially beyond the inner peripheral surface of the shell, whereby the routing of wiring inside of the shell is avoided.

* * * * *